US010604966B2

(12) United States Patent
Backhaus et al.

(10) Patent No.: US 10,604,966 B2
(45) Date of Patent: Mar. 31, 2020

(54) CAM LOCK WITH A CLOSURE ELEMENT WHICH CAN BE FIXED TO A LOCKING SHAFT AT DIFFERENT HEIGHTS

(71) Applicant: EMKA Beschlagteile GmbH & Co. KG, Velbert (DE)

(72) Inventors: Michael Backhaus, Dortmund (DE); Murat Malkoc, Bochum (DE)

(73) Assignee: EMKA Beschlagteile GmbH & Co. KG, Velbert (DE)

( * ) Notice: Subject to any disclaimer, the term of this patent is extended or adjusted under 35 U.S.C. 154(b) by 0 days.

(21) Appl. No.: 16/093,135

(22) PCT Filed: Apr. 20, 2017

(86) PCT No.: PCT/EP2017/059326
§ 371 (c)(1),
(2) Date: Oct. 11, 2018

(87) PCT Pub. No.: WO2017/182541
PCT Pub. Date: Oct. 26, 2017

(65) Prior Publication Data

US 2019/0383059 A1 Dec. 19, 2019

(30) Foreign Application Priority Data

Apr. 22, 2016 (DE) ..... 10 2016 107 467

(51) Int. Cl.
*E05B 35/00* (2006.01)
*E05B 17/04* (2006.01)
(Continued)

(52) U.S. Cl.
CPC ..... *E05B 35/008* (2013.01); *E05B 63/06* (2013.01); *E05B 1/0092* (2013.01); *E05B 17/04* (2013.01); *E05C 3/042* (2013.01); *E05C 3/145* (2013.01)

(58) Field of Classification Search
CPC ..... Y10T 292/1009; Y10T 292/03; Y10T 292/1043; Y10T 292/1075;
(Continued)

(56) References Cited

U.S. PATENT DOCUMENTS 2,066,541 A * 1/1937 Schenk ..... B25B 5/10 411/437
3,402,958 A * 9/1968 Barry ..... E05C 3/042 292/62
(Continued)

FOREIGN PATENT DOCUMENTS

DE 202007014642 U1 10/2007
DE 20 2013 004 046 U1 11/2014
(Continued)

OTHER PUBLICATIONS

Viethen, "International Search Report PCT/EP2017/059326", dated Jun. 30, 2017, 2 pages.

*Primary Examiner* — Lloyd A Gall
(74) *Attorney, Agent, or Firm* — Johnson, Marcou, Isaacs & Nix, LLC; Jennifer S. Stachniak

(57) ABSTRACT

A casement lock (1) includes an actuation lug (2); a locking shaft (3) coupled to the actuation lug (2) and having two opposite flattened axial regions (5) at a free end (4) of the locking shaft and a circumferential profiling (6) between the flattened axial regions (5); and a cage (8) supporting a closure element (7) configured to be placed with an opening (9) on the free end (4) of the locking shaft (3) and fixed to the locking shaft (3). A locking element (14) is provided on the cage (8), which, in a locking position, secures the cage (8) on the locking shaft (3) against tilting. In a release position of the locking element (14), the cage (8) can be tilted relative to the locking shaft (3) and is moveable in an
(Continued)

axial direction along the locking shaft (3) only in a state when tilted relative to the locking shaft (3).

9 Claims, 3 Drawing Sheets

(51) Int. Cl.

| | |
|---|---|
| ***E05C 3/14*** | (2006.01) |
| ***E05B 63/06*** | (2006.01) |
| *E05B 1/00* | (2006.01) |
| *E05C 3/04* | (2006.01) |

(58) Field of Classification Search
CPC ..... Y10T 292/1094; Y10S 292/38; F16B 37/085; F16B 37/0814; E05B 35/008; E05B 63/06; E05B 17/04; E05B 1/0092; E05B 17/041; E05B 17/044; E05C 3/145; E05C 3/042
USPC ..... 70/379 R, 379 A, 380, 372, 391, 461, 70/DIG. 79, 127, 128, 139, 466; 292/DIG. 53, DIG. 54, DIG. 60, DIG. 64
See application file for complete search history.

(56) References Cited

U.S. PATENT DOCUMENTS

| | | | | |
|---|---|---|---|---|
| 4,583,775 | A * | 4/1986 | Bisbing | E05B 17/0025 292/64 |
| 5,234,236 | A * | 8/1993 | Gromotka | E05B 63/0056 292/194 |
| 8,459,703 | B2 | 6/2013 | Anderson et al. | |
| 2016/0076283 | A1 * | 3/2016 | Ramsauer | E05C 3/042 70/449 |
| 2017/0073921 | A1 * | 3/2017 | Mitola | E02D 29/1427 |
| 2017/0306651 | A1 * | 10/2017 | Hastings | E05B 39/00 |

FOREIGN PATENT DOCUMENTS

| | | | |
|---|---|---|---|
| DE | 4421903 | A1 | 1/2015 |
| GB | 2485190 | A | 5/2012 |
| WO | 2013182278 | A1 | 12/2013 |
| WO | 2017182541 | A1 | 10/2017 |

* cited by examiner

CAM LOCK WITH A CLOSURE ELEMENT WHICH CAN BE FIXED TO A LOCKING SHAFT AT DIFFERENT HEIGHTS

CROSS REFERENCE TO RELATED APPLICATIONS

The instant application should be granted the priority dates of Apr. 20, 2017, the filing date of the international patent application PCT/EP2017/059326 and Apr. 22, 2016, the filing date of German Patent Application DE 10 2016 107 467.5.

BACKGROUND OF THE INVENTION

The present invention relates to a casement, or cam, lock, with an actuation lug, a locking shaft which is coupled to the actuation lug, which locking shaft comprises two opposite flattened axial regions at least at its free end and comprises a profiled circumferential design in the circumferential direction between the flattened axial regions, and a cage which supports a closure element and which can be placed with an opening on the free end of the locking shaft and which can be fixed to the locking shaft, wherein a locking element is provided on the cage.

A casement lock is known from DE 20 2013 004 046 U1. In order that the axial position of the closure element on the locking shaft can be changed in this embodiment, a nut is provided which interacts with the cage supporting the closure element. The profiling on the locking shaft is constituted as an external thread, so that the height of the closure element on the locking shaft can be adjusted by rotating the nut. The drawback associated with the use of a nut for the height adjustment of the closure element is that the height of the closure element can be displaced by unintentional actuation of the nut. The effect of this can be that the door to be locked by the casement lock is not pulled sufficiently tightly to the frame in the closed state.

A casement lock with the features mentioned at the outset is known from U.S. Pat. No. 8,459,703 B2, wherein the closure element constituted as a locking tongue can be rotated relative to the locking shaft in a release position of a locking element, wherein the closure element can be moved axially along the locking shaft in the state rotated relative to the locking shaft. On the other hand, the closure element cannot be moved along the locking shaft in the rotated-back state and the locking position of the locking element. If the locking element unintentionally gets into the release position, a relative rotation with respect to the closure element can take place when the locking shaft is actuated, so that the closure element is no longer securely fixed to the locking shaft. Further casement locks are known from DE 20 2007 014 642 U1 and DE 44 21 903 A1.

SUMMARY OF THE INVENTION

The problem of the present invention, therefore, is to overcome the drawbacks described with reference to the prior art and in particular to specify a casement lock, wherein unintentional shifting of the axial position of the closure element on the locking shaft is better prevented.

The problem is solved in particular by a casement lock with the features mentioned at the outset, wherein the locking element in a locking position fixes the cage on the locking shaft against tilting, wherein in a release position of the locking element the cage can be tilted relative to the locking shaft and the cage can be moved in the axial direction along the locking shaft only in a state when tilted relative to the locking shaft.

Tilting is to be understood to mean that the cage is tilted about an (imaginary) tilting axis, which is orientated obliquely, in particular orthogonally to the locking shaft. For example, the cage is orientated orthogonally to the locking shaft in the locking position, whereas in the release position the cage is tilted, for example, with a free end onto the locking shaft, so that the locking shaft and the part of the cage extending to the free end enclose an angle of less than 90°.

In order to change the cage in its axial position relative to the locking shaft, it is thus necessary for both the locking element to be actuated and also for the cage to be tilted relative to the locking shaft. Unintentional displacement of the cage along the locking shaft is thus prevented.

The locking element can be moved relative to the cage and can be brought manually from the locking position into the release position. For example, the locking element can be displaced linearly, can be swivelled about a swivelling axis or rotated about a rotation axis, in order to be brought into the locking or release position.

According to the invention, the locking element in the locking position secures the cage against tilting relative to the locking shaft and, in the release position, enables tilting of the cage relative to the locking shaft, wherein the cage can be moved in the axial direction along the locking shaft only in the state when tilted relative to the locking shaft.

In an embodiment of the casement lock, provision is made such that the opening of the cage comprises two holding sections which are arranged axially offset with respect to one another in the longitudinal direction of the locking shaft and which in each case comprise a contact region for the locking shaft on a surface facing the opening and a cutout on the side lying opposite the contact region, wherein at least one of the contact regions comprises a negative profiling corresponding to the profiling of the locking shaft and wherein the contact regions and cutouts formed on the two holding sections are in each case arranged opposite one another and with an axial offset with respect to one another, so that the cage in a tilted state, in which the locking shaft engages in the cutouts, can be displaced along the locking shaft and, in an aligned position, enters with the negative profiling of the at least one holding section into engagement with the profiling of the locking shaft, as a result of which an axial displacement of the cage is prevented.

The cage thus comprises a holding section facing the actuation lug and a holding section facing the free end of the locking shaft. The holding sections each comprise a cutout lying opposite one another relative to the locking shaft, so that the locking shaft is arranged in the cutouts in the tilted state of the cage. In the aligned state, the locking shaft comes into contact with the contact regions of the holding section, wherein an axial displacement along the locking shaft is prevented on account of the negative profiling corresponding to the profiling of the locking shaft.

Inasmuch as it would in principle be sufficient for the securing against displacement of the cage with respect to the locking shaft that a negative profiling corresponding to the profiling of the locking shaft is formed only on the contact region of one holding section, in a preferred embodiment the locking shaft comprises in each case a profiling in the circumferential direction between precisely two flattened axial regions, wherein in each case a negative profiling corresponding to the profiling of the locking shaft is formed on the contact regions of the two holding sections. A particularly secure fixing of the cage in the axial direction is thus provided.

In a further embodiment, provision can be made such that the cutout of the holding section facing the actuation lug is located on the side of the cage from which the closure element extends away from the cage. The effect of this is that the closure element with its free end in the tilted position is inclined in the direction of the actuation lug. In the closing position of the casement lock, the cage is however tensioned by the closure element which lies against the door, such that the cage is pressed against the locking shaft with the contact regions of the two holding sections. Such an embodiment is thus particularly stable.

In a preferred embodiment, the locking element is a pin, which is inserted into the cage in the locking position and which, in the release position, is at least partially pulled out of the cage. The pin is thus held in the cage in a linearly movable manner. In the locking position, the pin is arranged in particular in the cutout of a holding section.

In order to ensure that the pin is secured against unintentional actuation, the pin in the locking position projects with one end over the cage, wherein a stop is formed on the projecting end of the pin, which stop is in contact with the cage in the release position. The stop thus prevents the pin from not being able to be brought into the release position without further measures.

In a simple embodiment for the release of the stop, provision is made such that the end of the pin comprising the stop is designed to be resiliently deflectable, so that the pin can be brought into the release position after the end has been deflected.

So that the pin does not have to be completely removed from the cutout of the holding section in order to reach the release position, provision is made such that the pin comprises a solid profile section and a recess section comprising a recess, which are arranged on the pin in such a way that the solid profile section in the locking position prevents tilting of the locking shaft and that in the release position the locking shaft can be arranged in the recess of the recess section, so that the cage can be tilted relative to the locking shaft. The solid profile section is thus arranged in the locking position in the cutout of the holding section in such a way that tilting of the locking shaft is impossible. The recess of the recess section, on the other hand, is shaped in such a way that the locking shaft in the release position of the pin can be tilted sufficiently far into the cutout of the holding section.

In this connection, provision is in particular made such that the recess comprises a contact surface which is angled relative to the axial direction of the locking shaft, onto which contact surface the locking shaft can be tilted over the entire area in the release position. A maximum tilting angle of the cage is thus defined by the angled contact surface.

The closure element is the element of the casement lock which, in the closed position, secures for example the door of a cabinet against opening and which, in the opening position of the casement lock, is rotated so far together with the locking shaft that opening of the door is possible. The closure element can be fitted detachably to the cage as an independent component. It is preferable however for the closure element to be a locking tongue or a roller, which itself or the holder whereof is constituted in one piece with the cage.

According to a further advantageous embodiment, the casement lock is constituted as a rotary clamping lock, wherein the locking shaft is coupled with an actuating shaft connected to the actuation lug, in particular by means of a connecting link guide. Rotary clamping locks are regarded here as a subgroup of the casement locks and are characterised in that the locking shaft is brought into the locking position by a further rotation of the actuation lug, wherein the closure element fixed to the locking shaft is brought into contact with a frame part holding the door or flap by an axial movement of the locking shaft under pretensioning, so that a firm and secure closure is ensured.

BRIEF DESCRIPTION OF THE DRAWINGS

The invention and the technical field are explained in the following by way of example with the aid of the figures. In the figures, schematically.

DETAILED DESCRIPTION OF SPECIFIC EMBODIMENTS

Figure 1:
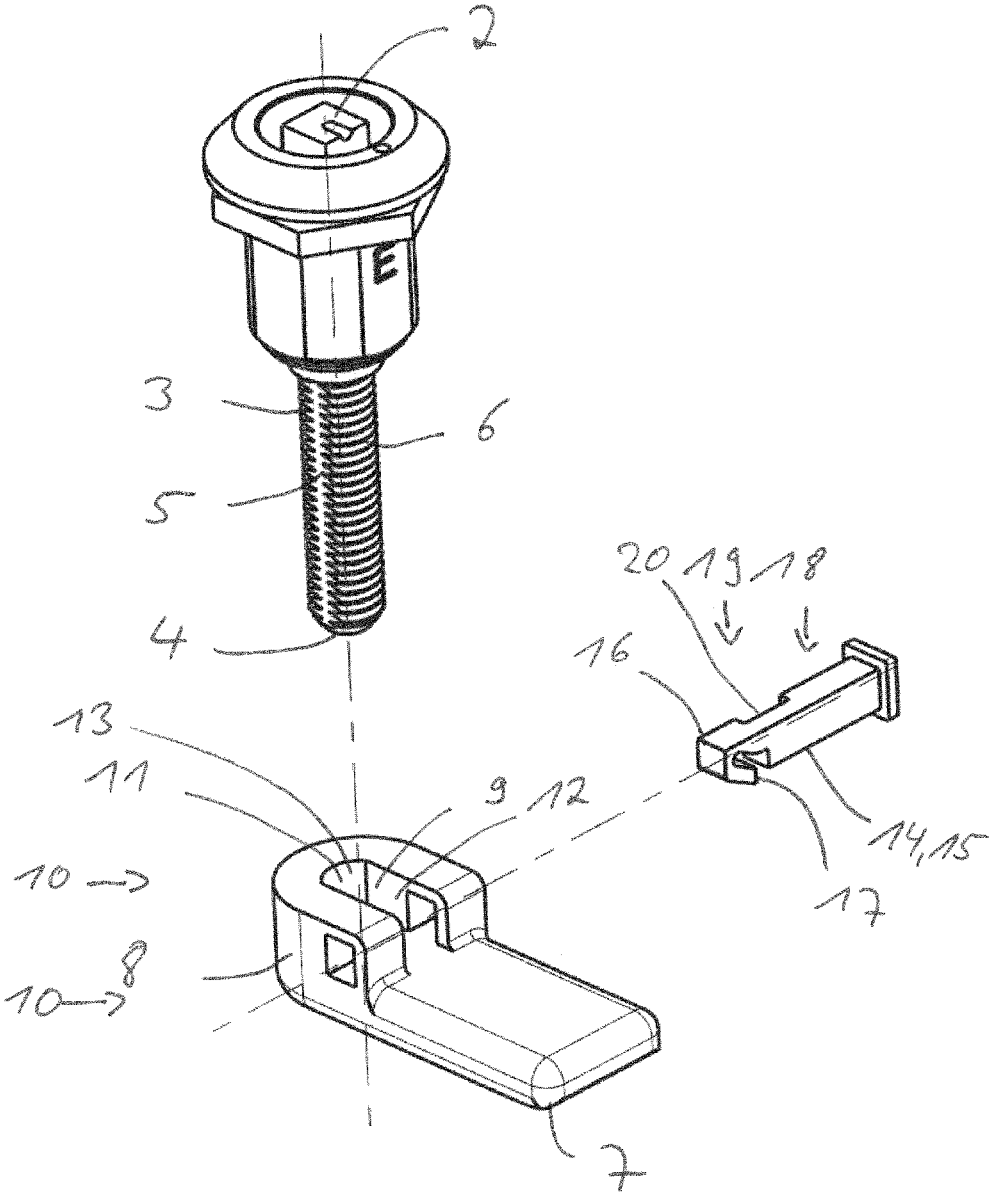
FIG. 1: shows a partial exploded view of a casement lock.

The Casement lock 1 represented in the figures comprises an actuation lug 2, which is rotatably mounted in a housing. The actuation lug 2 is coupled with a locking shaft 3, which is rotated upon rotation of the actuation lug 2. When the casement lock 1 is constituted as a rotary clamping lock, the locking shaft 3 is moved axially at least partially during a rotation of the actuation lug 2.

The locking shaft 3 comprises two opposite flattened axial regions 5 and profilings 6 arranged in the circumferential direction between the flattened axial regions 5. A cage 8 with a closure element 7 formed in one piece thereon can be pushed onto a free end 4 of the locking shaft 7.

Figure 3:
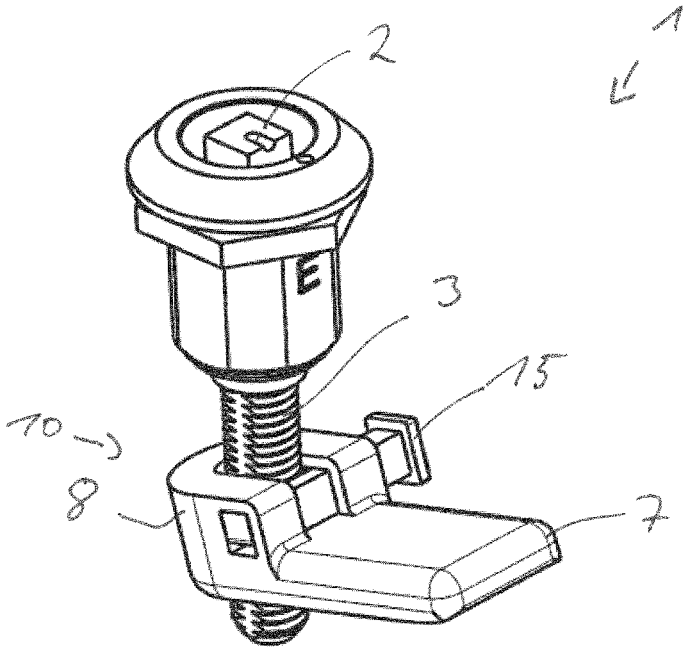
FIG. 3: shows the casement lock in a release position of the locking element and with a tilted closure element.

When the cage 8 is pushed onto the locking shaft 3, the locking shaft 3 engages in an opening 9 formed in the cage 8. The opening 9 is shaped corresponding to the flattened axial regions 5 of the locking shaft 3, such that the cage is arranged on the locking shaft 3 in a non-rotatable manner. The cage 8 comprises a holding section 10, which in the assembled state faces the actuation lug 2, and a holding section 10, which in the assembled state faces the free end 4 of the locking shaft 3. The holding sections 10 each comprise a contact region 11 with a negative profile 13 corresponding to the profiling 6 of the locking shaft 3, and a cutout 12. The contact regions 11 and the cutouts 12 are each arranged opposite one another and with an axial offset relative to one another. This makes it possible for the cage 8 to be tiltable relative to locking shaft 3 (see FIG. 3), wherein in the tilted state the locking shaft 3 is arranged in both cutouts 12. In the aligned position, on the other hand, the profiling 6 of the locking shaft 3 is engaged with the negative profiling 13 of the contact regions 11 of the holding sections 10. The cage 8 cannot be displaced axially along the locking shaft 3 in this aligned position.

In order to prevent unintentional tilting of the cage 8 with respect to the locking shaft 3, a locking element 14 constituted as a pin 15 is provided, which can be inserted into the cage 8 through recesses in cage 8. The pin 15 comprises a solid profile section 18 and a recess section 19 with a recess 20. The pin 15 comprises a stop 17 at its end 16.

Figure 2:
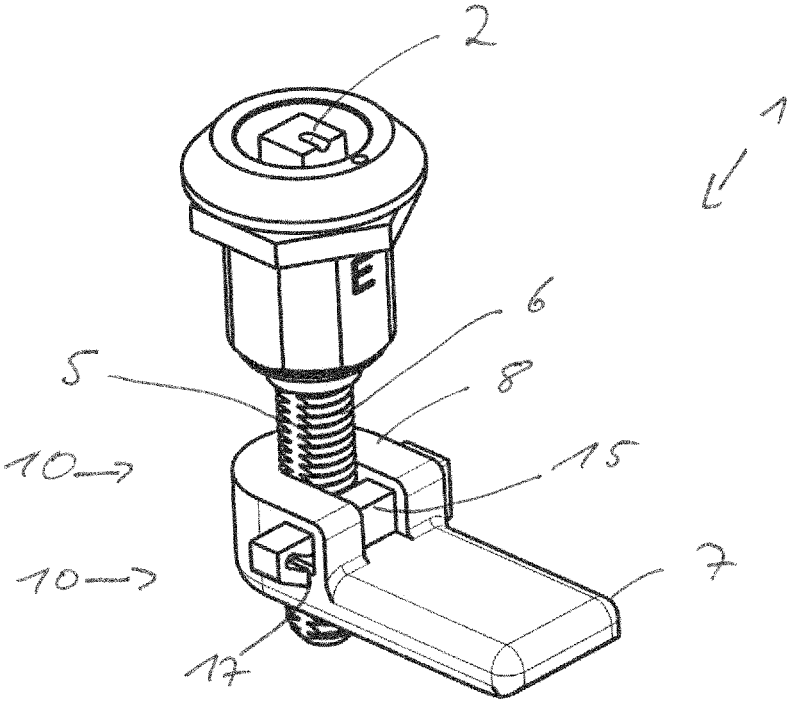
FIG. 2: shows the casement lock in a locking position of a locking element.

In the locking position represented in FIG. 2, the pin 15 is completely inserted into the cage 8 and projects with its end 16 over the cage 8, wherein the stop 17 engages the over cage 8. The stop 17 thus prevents the pin 15 from being able to be moved unintentionally to the cage 8. In the locking position, the pin 15 is arranged with its full profile section 18 in the cutout 12 of the holding section 10 facing the actuation lug 2, so that the cage 8 cannot be tilted relative to the locking shaft 3.

In order to bring the pin 15 into a release position, the stop 17 at the end 16 of the pin 15 has to be deflected, so that the pin 15 can be moved through the recesses in the cage 8. The release position is reached when the pin 15 is arranged with the recess 20 in the cutout 12 of the holding section 10 facing the actuation lug. In the release position, the cage 8 can be tilted relative to the locking shaft 3, so that the locking shaft 3 engages in the recess 20 on the pin 15. When the cage 8 is tilted, the cage 8 can be displaced axially relative to the locking shaft 3 (see FIG. 3).

Figure 4:
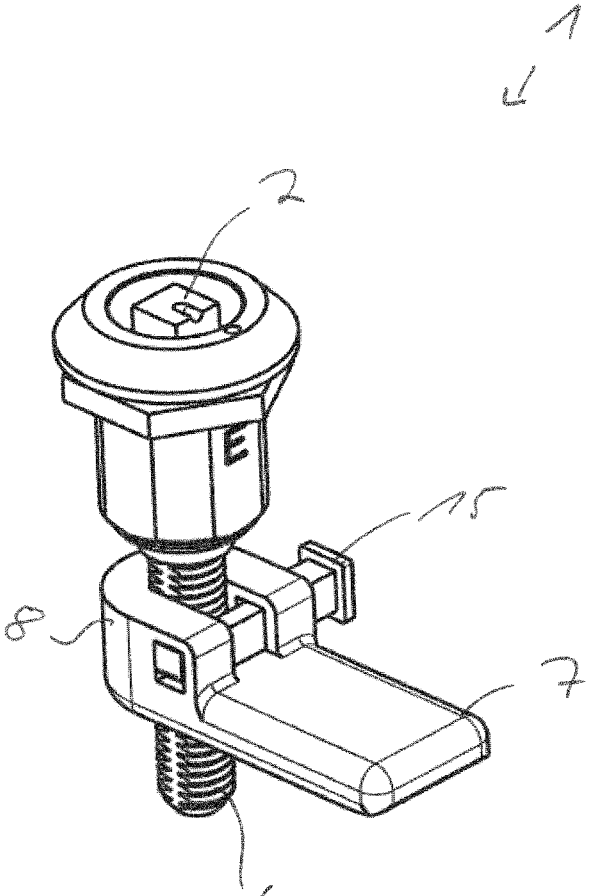
FIG. 4: shows the casement lock in the release position and with an aligned closure element.

Once the cage 8 has reached a desired axial position on the locking shaft 3, the cage 8 is realigned, wherein the negative profiling 13 of the contact regions 11 engages with the profiling 6 of the locking shaft 3 (see FIG. 4). In order then to secure the cage 8 against tilting, the pin 15 is completely inserted into the cage 8.

The specification incorporates by reference the disclosure PCT/EP2017/059326, filed Apr. 20, 2017 and DE 10 2016 107 467.5, filed Apr. 22, 2016.

The present invention is, of course, in no way restricted to the specific disclosure of the specification and drawings, but also encompasses any modifications within the scope of the appended claims.

LIST OF REFERENCE NUMBERS

1 casement lock
2 actuation lug
3 locking shaft
4 free end
5 flattened axial region
6 profiling
7 closure element
8 cage
9 opening
10 holding section
11 contact region
12 cutout
13 negative profiling
14 locking element
15 pin
16 end
17 stop
18 full profile section
19 recess section
20 recess

The invention claimed is:

1. A casement lock (1), comprising:

an actuation lug (2);

a locking shaft (3) coupled to the actuation lug (2), the locking shaft comprising two opposite flattened axial regions (5) at least at a free end (4) of the locking shaft and a profiling (6) in a circumferential direction between the flattened axial regions (5); and a cage (8) supporting a closure element (7) configured to be placed with an opening (9) on the free end (4) of the locking shaft (3) and fixed to the locking shaft (3), wherein a locking element (14) is provided on the cage (8), wherein the locking element in a locking position secures the cage (8) on the locking shaft (3) against tilting, wherein in a release position of the locking element (14), the cage (8) is tiltable relative to the locking shaft (3), and wherein the cage (8) is moveable in an axial direction along the locking shaft (3) only in a state when tilted relative to the locking shaft (3).

2. The casement lock (1) according to claim 1, wherein the opening (9) of the cage (8) comprises two holding sections (10) arranged axially offset with respect to one another in the longitudinal direction of the locking shaft (3), wherein each holding section comprises a contact region (11) for the locking shaft on a surface facing the opening (9) and a cutout (12) on a side lying opposite the contact region (11), wherein at least one of the contact regions (11) comprises a negative profiling (13) corresponding to the profiling (6) of the locking shaft (3), and wherein the contact regions (11) and cutouts (12) formed on the two holding sections (10) are in each case arranged opposite one another and with an axial offset with respect to one another, so that the cage (8) in a tilted state, in which the locking shaft (3) engages in the cutouts (12), is displaceable along the locking shaft (3) and, in an aligned position, enters with the negative profiling (13) of the at least one holding section (10) into engagement with the profiling (6) of the locking shaft (3), thereby preventing an axial displacement of the cage (8).

3. The casement lock (1) according to claim 2, wherein the locking shaft (3) comprises in each case a profiling (6) in the circumferential direction between the two flattened axial regions (5), and wherein in each case a negative profiling (13) corresponding to the profiling (6) of the locking shaft (3) is formed on the contact regions (11) of the two holding sections (10).

4. The casement lock (1) according to claim 2, wherein the cutout (12) of the holding section (10) facing the actuation lug (2) is located on a side from which the closure element (7) extends away from the cage (8).

5. The casement lock (1) according to claim 1, wherein the locking element (14) is a pin (15), wherein the pin (15) is insertable into the cage (8) in the locking position and wherein the pin (15), in the release position, is at least partially pulled out of the cage (8).

6. The casement lock (1) according to claim 5, wherein the pin (15) in the locking position projects with one end (16) over the cage (8), wherein a stop (17) is formed on the projecting end (16) of the pin (15), wherein the stop engages over the cage (8) in the locking position.

7. The casement lock (1) according to claim 6, wherein the end (16) of the pin (15) comprising the stop (17) is resiliently deflectable, so that the pin (15) is moveable into the release position after the end (16) has been deflected.

8. The casement lock (1) according to claim 5, wherein the pin (15) comprises a solid profile section (18) and a recess section (19) comprising a recess (20), wherein the profile section (18) and the recess section (19) are arranged on the pin (15) in such a way that the solid profile section (18) in the locking position prevents a deflection of the cage (8) and that in the release position the locking shaft (3) is arranged in the recess (20) of the recess section (19), so that the cage (8) can be deflected relative to the locking shaft (3).

9. The casement lock (1) according to claim 8, wherein the recess (20) comprises a contact surface which is angled relative to the axial direction, wherein the locking shaft (3) is tiltable onto the contact surface over the entire area in the release position.

* * * * *